US005732574A

United States Patent [19]

Hauser

[11] Patent Number: 5,732,574

[45] Date of Patent: Mar. 31, 1998

[54] WASHING MACHINE TRANSMISSION

[75] Inventor: Hans Hauser, Brunswick Hills, Ohio

[73] Assignee: White Consolidated Industries, Inc., Cleveland, Ohio

[21] Appl. No.: 658,754

[22] Filed: Jun. 5, 1996

[51] Int. Cl.[6] ..... D06F 17/08

[52] U.S. Cl. ..... 68/133; 68/23.7; 74/32; 74/33

[58] Field of Search ..... 68/23.7, 133; 74/32, 74/33

[56] References Cited

U.S. PATENT DOCUMENTS

| | | | |
|---|---|---|---|
| 2,021,785 | 11/1935 | Hume | 68/133 X |
| 2,053,158 | 9/1936 | McCabe | 68/133 X |
| 2,098,075 | 11/1937 | Watts | 68/133 X |
| 2,733,610 | 2/1956 | Lodge | 68/23.7 X |
| 3,779,090 | 12/1973 | Ostenberg et al. | 74/81 |
| 4,566,295 | 1/1986 | Mason | 68/23.7 X |
| 5,509,284 | 4/1996 | Hauser | 68/23.7 |
| 5,522,242 | 6/1996 | Hauser | 68/23.7 |

*Primary Examiner*—Philip R. Coe
*Attorney, Agent, or Firm*—Pearne, Gordon, McCoy & Granger LLP

[57] ABSTRACT

A transmission including a housing, an agitator shaft rotatably mounted to the housing, an input shaft rotatably mounted to the housing, and an agitation system which back-and-forth agitation of the agitator shaft when the input shaft rotates relative to the housing. The agitation system includes a rack drivingly connected to the agitator shaft, an eccentric gear drivingly connected to the input shaft, an idler shaft rotatably mounting the eccentric gear to the housing, and a rolling-contact bearing rotatably connecting the eccentric gear and the rack. The rolling contact bearing is press-fit with the eccentric gear and the rack and has a rotational axis displaced from a rotational axis of the eccentric gear. The idler shaft has a first end press-fit into the eccentric gear and a second end slip-fit into a sleeve bearing of the housing. A bearing pad is located between the housing and an end of the rack connected to the agitator shaft. The housing has a surface facing the rack so that a bearing pad removably secured to an end of the rack rides along the surface to support the end of the rack during movement of the rack. The housing also has a laterally extending flange located at a parting line of the housing. A counterweight is secured to a side of the flange facing away from the housing parting line with a threaded fastener. The housing is rotatably connected to the washing machine with a rolling-contact bearing and a two-part bearing retainer.

10 Claims, 5 Drawing Sheets

Fig.10
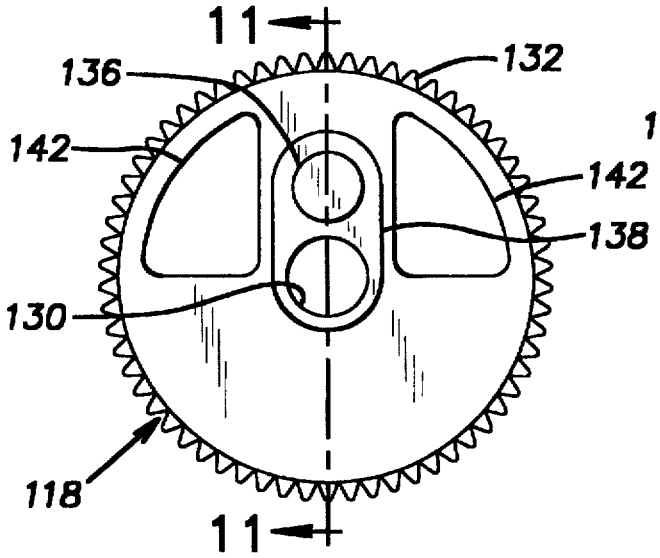
Fig.11
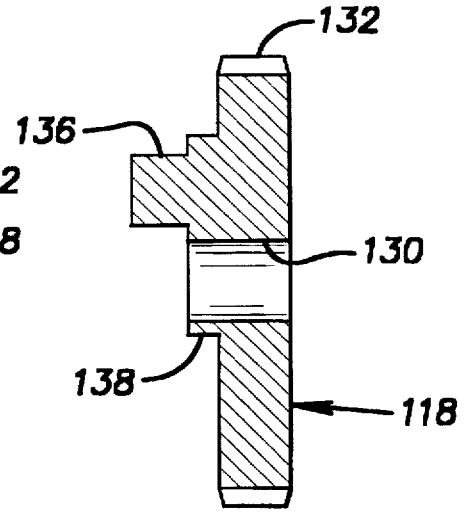
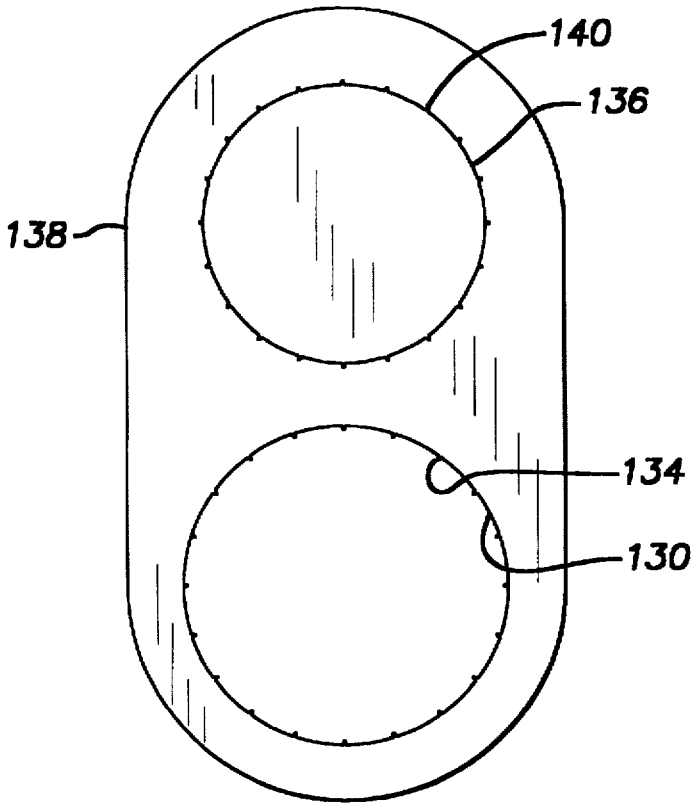
Fig.12

WASHING MACHINE TRANSMISSION

BACKGROUND OF THE INVENTION

1. Field of the Invention

The present invention pertains to a transmission for a domestic washing machine and, more particularly, to a transmission which both agitates and spins appropriate members of the washing machine.

2. Description of Related Art

Automatic washing machines typically hold clothing or other fabric articles in a perforate basket, immerse the clothing in water, and wash the clothing under the influence of oscillating agitator. After washing, the clothing is rinsed with water and the basket is rotated at a high speed to centrifugally extract the rinse water from the clothing and the basket. Typically, a mechanical transmission produces the oscillatory motion of the agitator upon rotation of a drive motor in one direction and produces the continuous rotation the basket upon rotation of the drive motor in the other direction.

U.S. Pat. No. 5,509,284, the disclosure of which is expressly incorporated herein in its entirety by reference, is exemplary of such transmissions. The '284 patent discloses a transmission having an input shaft in-line with an agitator shaft and uses an off-center gear in combination with a rack and pinion mechanism to produce an oscillatory motion of the agitator shaft from the rotary motion of the input shaft. The off-center gear rotates about an idler shaft which is secured to the housing. The transmission also has a clutch/brake assembly which rotates the housing with the input shaft to produce a unitary rotary motion of the agitator shaft from the rotary motion of the input shaft. A counterweight is slidably received in a cutout of a lower housing section to balance the transmission during high speed spin. The counterweight is retained in the cutout by an upper housing section.

The transmission, disclosed by the '284 patent, suffers from several disadvantages. The transmission produces a relatively large amount of noise during operation of the washing machine. The transmission is relatively expensive to produce because of high tolerances required at the interface between the off-center gear and the rack. Additionally, a relatively high rate of wear may be produced at an interface between the rack and the housing. Furthermore, the transmission may leak lubricant when the upper housing section does not properly seat on the lower housing section due to interference from the counterweight which is not rigidly attached to the housing.

SUMMARY OF THE INVENTION

The present invention provides an improved transmission for a washing machine which overcomes at least some of the above-noted problems of the prior art. The transmission includes a housing, an agitator shaft rotatably mounted to the housing, an input shaft rotatably mounted to the housing, and an agitation system which provides back-and-forth agitation of the agitator shaft when the input shaft rotates relative to the housing. The agitation system includes a rack drivingly connected to the agitator shaft, an eccentric gear rotatably mounted to the housing and drivingly connected to the input shaft, and a rolling-contact bearing rotatably connecting the eccentric gear and the rack. The bearing has a rotational axis displaced from a rotational axis of the eccentric gear. Preferably, the rolling contact bearing is pres-fit with both the eccentric gear and the rack. The rolling-contact bearing reduces the manufacturing complexity, and therefore manufacturing cost, of the transmission by eliminating several high tolerance machined features of the various components. The rolling contact bearing also provides a reduction in the amount of noise produced by the transmission by providing a tighter or closer mesh along chain of power transmission members.

According to a preferred embodiment of the invention, the agitation system includes an idler shaft which rotatably connects the eccentric gear to the housing. The idler shaft has a first end fixed to the eccentric gear and a second end rotatably mounted to the housing so that the idler shaft rotates with the eccentric gear relative to the housing. Preferably, the idler shaft is press-fit with the eccentric gear. Securing the idler shaft to the eccentric gear provides a reduction in the amount of noise produced by the transmission by significantly reducing backlash between the eccentric gear and the input shaft.

The preferred embodiment of the invention also includes a bearing pad located between the housing and an end of the rack connected to the agitator shaft. Preferably, the housing has a surface facing the rack and the bearing pad is secured to the rack and rides along the surface of the housing to support the end of the rack during movement of the rack. The bearing pad reduces wear due contact between the rack and the housing as the rack moves relative to the housing.

The preferred embodiment of the invention additionally includes a counterweight secured to the housing and axially spaced from a parting line of the housing. The counterweight substantially balances the transmission during rotation of the housing. Preferably, a lower section of the housing has a laterally extending flange and the counterweight is secured to a side of the flange facing away from the parting line of the housing with a threaded fastener. Mounting the counterweight in this manner prevents the counterweight from interfering with the proper seating of the housing sections so that a fluid-tight seal is consistently obtained between the housing sections.

The preferred embodiment of the invention further includes a two-part bearing retainer which is rotatably connects the housing to the washing machine. The bearing retainer includes a retaining member rotatably connected to the housing with a rolling-contact bearing and a clamping member which is secured to the washing machine and engages the retaining member to clamp the retaining member to the washing machine. Preferably, the retaining member has a generally cylindrically-shaped exterior surface with a longitudinally facing abutment and the clamping member encircles the retaining member with a longitudinally facing abutment which engages the abutment of the bearing retainer. The two-part bearing retainer reduces the manufacturing complexity, and therefore manufacturing cost, of the transmission.

BRIEF DESCRIPTION OF THE DRAWINGS

These and further features of the present invention will be apparent with reference to the following description and drawings, wherein:

FIG. 10 is a plan view of an eccentric gear of the transmission of FIG. 2;

FIG. 11 is a cross-sectional view taken along line 11—11 of FIG. 10;

FIG. 12 is an enlarged fragmental view of the eccentric gear of FIG. 10 at a central bore and a stub shaft;

DETAILED DESCRIPTION OF THE PREFERRED EMBODIMENT

Figure 1:
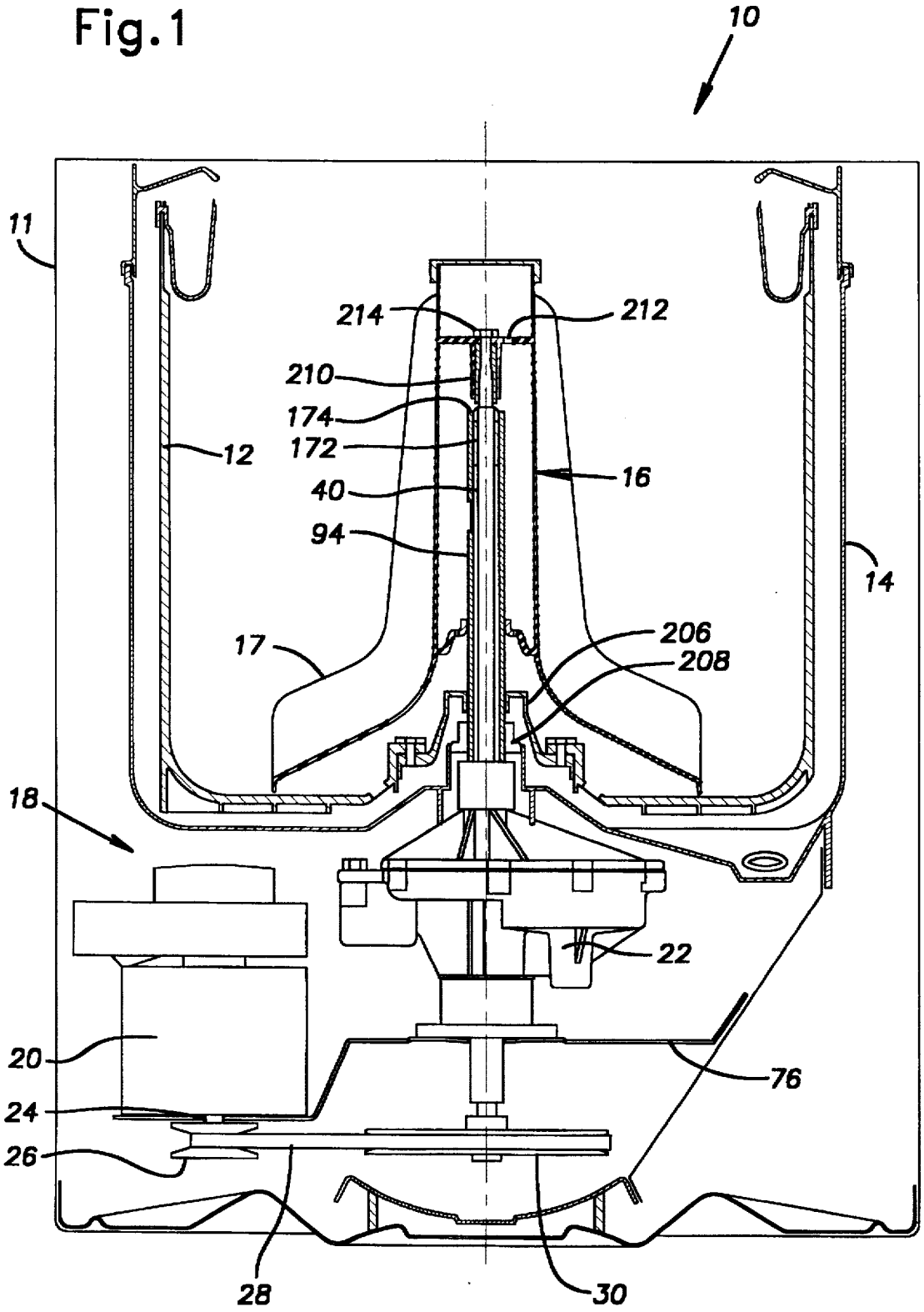
FIG. 1 is an elevational view, in cross-section, of a washing machine according to the present invention.

FIG. 1 illustrates a clothes washing machine 10 according to the present invention. The washing machine 10 includes a cabinet 11 having a door (not shown) pivotally mounted at an upper surface to permit access into the interior of the washing machine 10. The washing machine 10 also includes a perforated inner wash tub 12 which is surrounded by an imperforate outer wash tub 14. An agitator 16 is located within the inner tub 12 and has a series of upstanding vanes 17 formed thereon. A control console (not shown) is typically provided at a rear of the upper surface which includes control knobs and switches to allow a user to select a desired operating cycle or sequence of cycles for the washing machine 10.

Clothes or other articles to be washed are loaded into the inner tub 12 and the desired operating cycle is initiated. Typically, the operating cycle includes filling the outer tub 14 with wash water, oscillating the agitator 16 so that the vanes 17 engage and mix the clothes and wash water contained within the inner tub 12, draining wash fluid from the outer tub 14, filling and draining the outer tub 14 one or more times with rinse water, and spinning the inner tub 12 to centrifugally extract water from the articles therein.

The washing machine 10 includes a drive system 18 which both oscillates the agitator 16 and spins the inner tub 12. The drive system 18 includes a reversible electric motor 20 and a transmission 22. The motor 20 has a vertical axis output shaft 24 and drive pulley 26 on the output shaft 24. The motor 20 rotatably drives the transmission 22 with a drive belt 28 connecting the drive pulley 26 to a transmission pulley 30. The transmission 22 has two alternative modes of operation depending on the direction of rotation of the motor output shaft 24. In a first or agitation mode, the transmission 22 operates to oscillate the agitator 16 within the inner tub 12. In a second or spin mode, the transmission 22 operates to spin the inner tub 12 within the outer tub 14. It is submitted that the foregoing generally describes a rather well-known or conventional washing machine assembly, and is provided herein only to clarify the environment in which the present invention, to be described hereafter, is employed.

Figure 2:
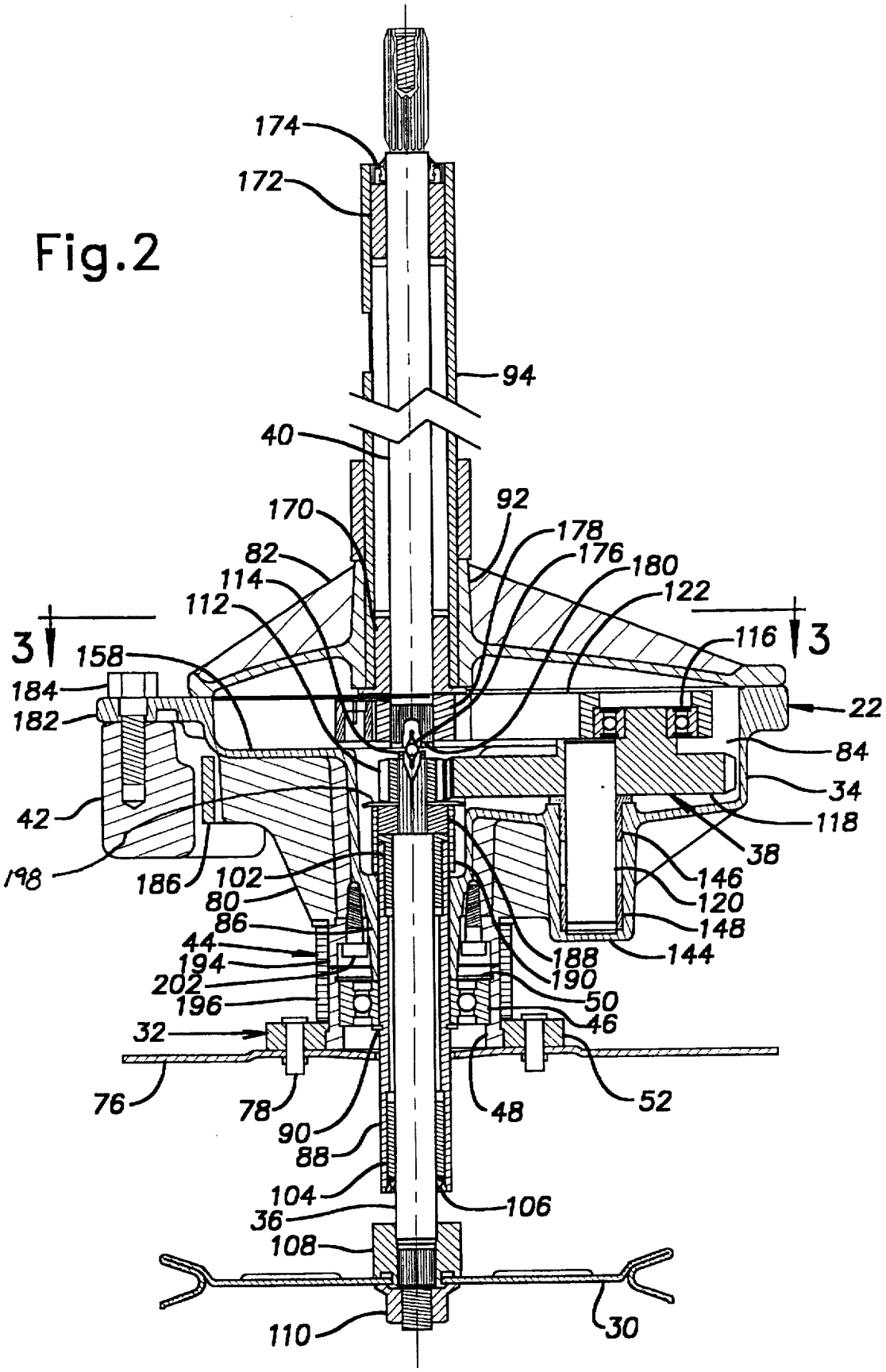
FIG. 2. is an elevational view in cross-section of the transmission of the washing machine of FIG. 1.

As best shown in FIG. 2, the transmission 22 includes a lower bearing assembly 32, a housing 34, an input shaft 36, an agitation system 38, an agitator shaft 40, a counterweight 42, and a clutch/brake system 44. The lower bearing assembly 32 includes a rolling-contact bearing 46, a retaining ring 50, and a two part bearing retainer having a retaining member 48 and a clamping member 52. The rolling-contact bearing 46 of the illustrated embodiment is a radial ball bearing having inner and outer rings and a plurality balls therebetween. Preferably, the bearing 46 is a light series, single row, radial ball bearing according to ABEC-1 tolerance limits.

Figure 5:
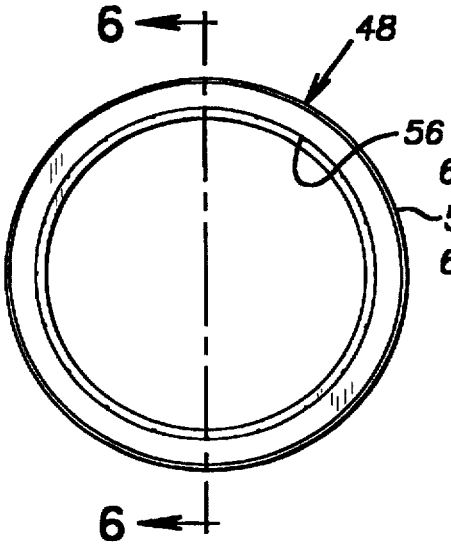
FIG. 5 is a plan view of a bearing retainer of the transmission of FIG. 2.
Figure 6:
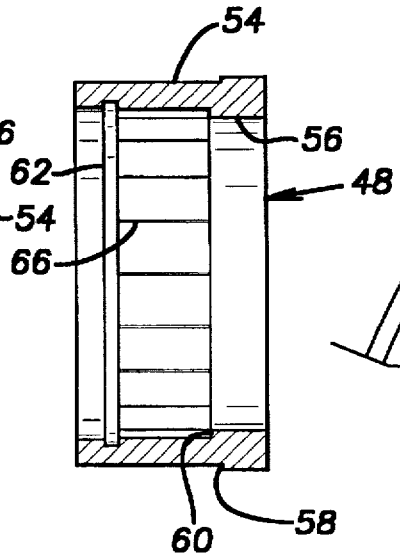
FIG. 6 is a cross-sectional view taken along line 6—6 of FIG. 5.
Figure 7:
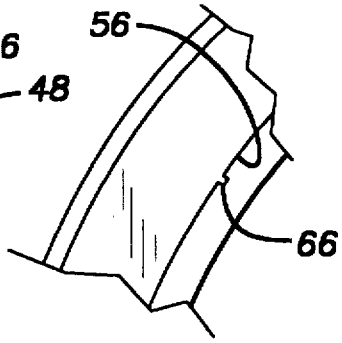
FIG. 7 is an enlarged fragmental view of the bearing retainer of FIG. 5 at a crush rib.

As best shown in FIGS. 5–7, the retaining member 48 has a generally cylindrically-shaped exterior surface 54 and a central bore 56. The exterior surface 54 has an upper portion and a lower portion with an outer diameter larger than the outer diameter of the upper portion to form an upward facing abutment 58. The central bore 56 has an upper portion and a lower portion with an inner diameter smaller than the inner diameter of the upper portion to form an upward facing abutment 60. The upper portion of the central bore 56 is sized to receive the outer ring of the bearing 46 with an interference or press-fit. The upper portion of the central bore 56 is provided with a groove 62 about the periphery of the bore 56 that is sized for receiving the retaining ring 50 to axially secure the bearing 46 against the abutment 60.

The upper portion of the central bore 56 is provided with a plurality of axially extending crush ribs 66 which are equally spaced about the circumference of the upper portion. The retaining member 48 of the illustrated embodiment has twenty equally spaced crush ribs 66. The crush ribs 66 are crushed or deformed as the bearing 46 is pressed into the central bore 56 of the retaining member 48 to provide a tight lock against relative rotation between the inner ring of the bearing 46 and the retaining member 48. The crush ribs 66 provide the interference fit between the bearing 46 and the retaining member 48. If the bearing 46 has an outer diameter of about 2.0472/2.0467 inches, for example, the crush ribs 66 can have a radial length of about 0.015 inches and form an inner diameter of about 2.046/2.043 inches. Preferably, the crush ribs 66 have a increasing width in a radially outward direction. For example, the above-noted crush ribs can have a width which increases from about 0.006 inches at the inner diameter to about 0.013 inches at the wall of the central bore 56.

Figure 8:
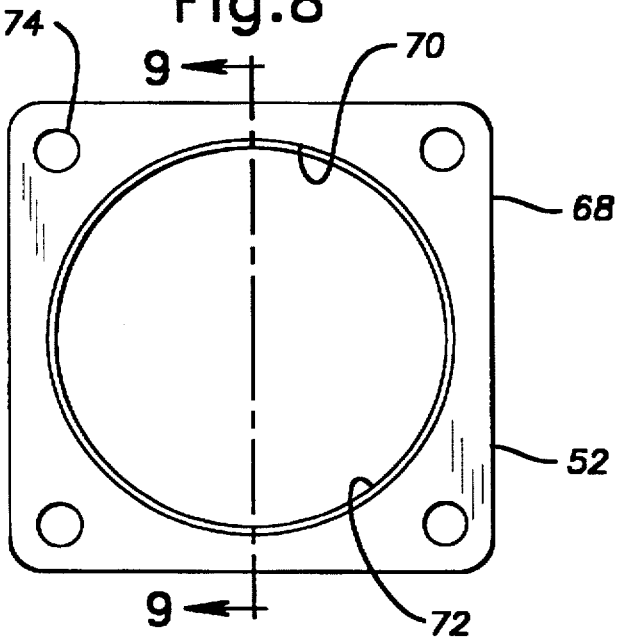
FIG. 8 is a plan view of a bearing retainer clamp of the transmission of FIG. 2.
Figure 9:
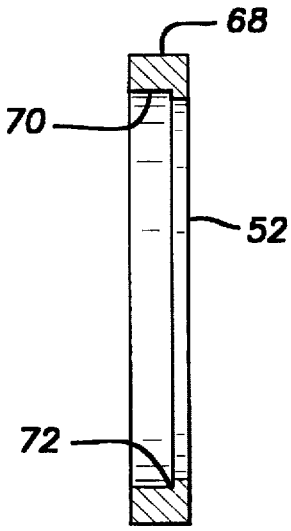
FIG. 9 is a cross-sectional view taken along line 8—8 of FIG. 8.

As best shown in FIGS. 8 and 9, the clamping member 52 has a generally rectangular shaped exterior surface 68 and a central bore 70. The central bore 70 includes an upper portion having a diameter sized to receive the upper portion of the retaining member exterior surface 54 and a lower portion sized to receive the lower portion of the retaining member exterior surface 54 to form a downward facing step or abutment 72. The four corners of the clamping member 52 are provided with longitudinally extending openings 74, generally parallel with the central bore 70, for receiving fastening members.

As best shown in FIG. 2, the clamping member 52 is secured to a frame wall 76 of the washing machine 10 frame by fastening members 78 such as, for example, threaded bolts and nuts, which extend through the openings 74 (FIG. 8) in the clamping member 52 and openings in the frame wall 76. The retaining member 48 is clamped between the clamping member 52 and the frame wall 76 by the downward facing abutment 72 of the clamping member 52 engaging the upward facing abutment 58 of the bearing retainer 48 and the frame wall 76 engaging the bottom surface of the bearing retainer 48.

The housing 34 includes separable lower and upper sections 80, 82 which may be machined from suitably formed metal castings. The lower and upper sections 80, 82 together form an interior cavity 84 and enclose the parts of the transmission 22. The lower housing section 80 has, at its lower end, a collar portion or hub 86 which is vertically supported on the inner ring of the bearing 46. A lower housing extension or input tube 88 is tightly received in a cylindrical bore of the hub 86. The input tube 88 extends downwardly through the inner ring of the bearing 46 with a slight interference fit so that the input tube 88 is journaled in the bearing 46. The outer surface of the input tube 88 is provided with a groove for receiving a retaining ring 90 at the bottom surface of the inner ring of the bearing 46.

The upper housing section 82 has a collar portion or hub 92 with a cylindrical bore. An upper housing extension or agitator tube 94 is tightly received in the cylindrical bore of the hub 92. When the housing sections 80, 82 are properly assembled, the respective bores of the hubs 86, 92 are substantially coaxial.

Figure 3:
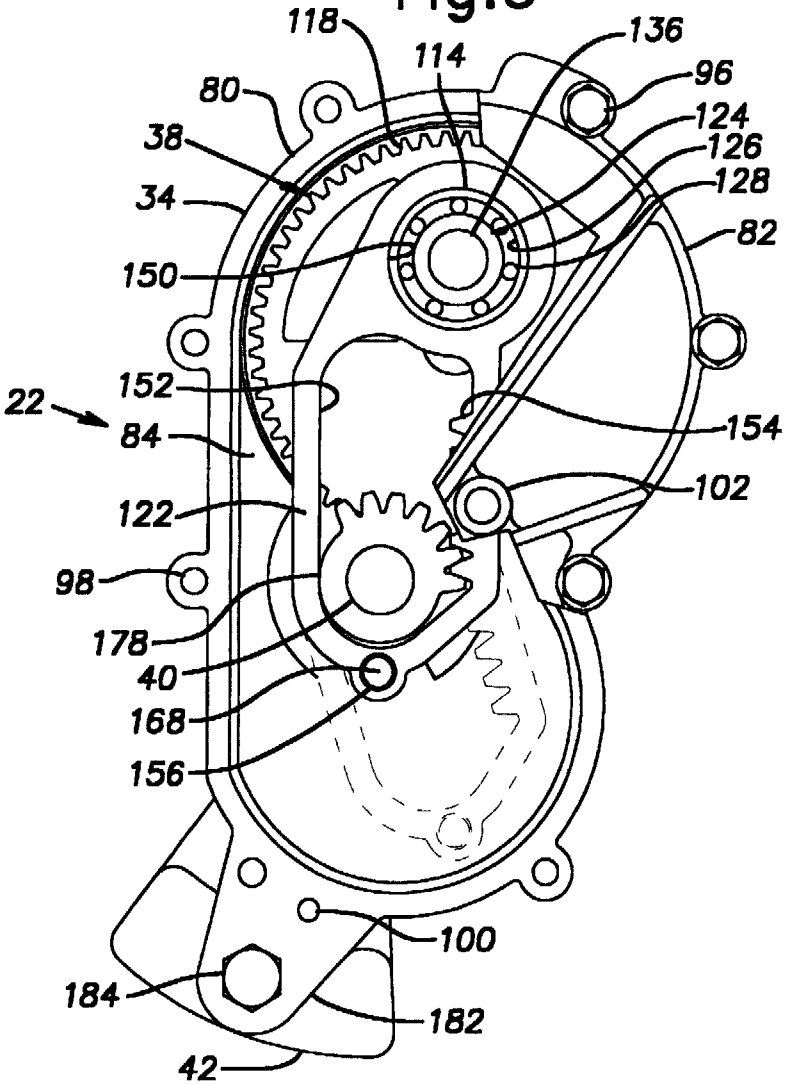
FIG. 3 is a plan view taken along line 3—3 of FIG. 2, with a portion of an upper housing section removed for clarity.

As best shown in FIGS. 2 and 3, the upper housing section 82 is secured to the lower housing section 80 with fastening members 96 such as, for example, hex washer screws which extend through openings in the upper housing section and into threaded holes 98 in the lower housing section 80. One or more dowel or spring pin 100 may be pressed into suitable holes in one of the housing sections 80, 82 while cooperating holes are formed in the opposite section to permit the housing sections 80, 82 to be indexed to one another on the plane of separation. A port in the upper housing section 82 permits the interior cavity 84 of the housing 34 to be filled or emptied of lubricant after a plug 102 is removed therefrom. A seal is obtained between the upper and lower housing sections 80, 82 to prevent leakage of the lubrication out of the housing 34 along the plane of separation.

As best shown in FIG. 2, the inside of the input tube 88 is provided with a flange bearing 102 at the top of the input tube 88 and a sleeve bearing 104 at the bottom of the input tube 88. The input shaft 36 is rotatively mounted, relative to the input tube 88 and lower housing section 80, within the bearings 102, 104. Preferably, a seal 106 is provided between the input shaft 36 and the input tube 88 at the bottom of the input tube 88 below the sleeve bearing 104.

The transmission pulley 30 is connected to the lower end of the input shaft 36 to supply power from the motor output shaft 24 to the transmission input shaft 26. A pulley hub 108 is splined on the lower end of the input shaft 36. The pulley hub 108 is engaged against a generally downward facing abutment by pulley nut 110 which is threaded onto an externally threaded lower end of the input shaft 36. The transmission pulley 30 is clamped between the pulley hub 108 and the pulley nut 110.

An input pinion 112 is splined onto the upper end of the input shaft 36 for drivingly connecting the input shaft 36 with the agitator system 38. A retaining ring 114 is provided to axially secure the input pinion 112 on the input shaft 36.

Figure 4:
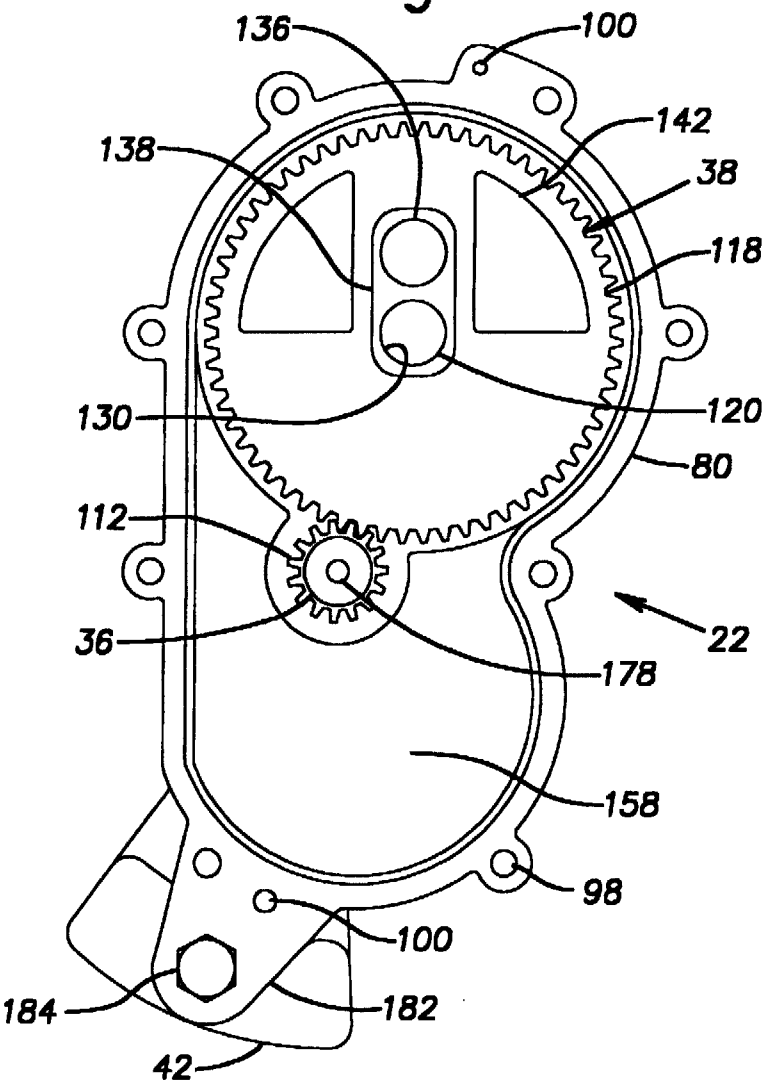
FIG. 4 is a plan view similar to FIG. 3 but with various components removed for clarity.

The agitation system 38 alters the constant unidirectional rotation of the input shaft 34 into an oscillating motion, that is a back-and-forth rotational movement, of the agitator shaft 40. As best shown in FIGS. 2–4, the agitation system 38 includes a rolling contact bearing 116, an eccentric gear 118, an idler shaft 120, and an agitator rack 122. The bearing 116 of the illustrated embodiment is a radial ball bearing having inner and outer rings 124, 126 and a plurality balls 128 therebetween. Preferably, the bearing 116 is a light series, single row, radial ball bearing according to ABEC-1 tolerance limits.

As best shown in FIGS. 10–12, the eccentric gear 118 has a central bore 130 and a plurality of teeth 132 about the periphery of the eccentric gear 118. The central bore is provided with a plurality of axially extending crush ribs 134 equally spaced about the circumference of the central bore 130. The eccentric gear 118 of the illustrated embodiment has twenty equally spaced-apart crush ribs 134. The crush ribs 134 provide an interference or press fit between the idler shaft 120 (FIGS. 2 and 4) and the eccentric gear 118. The crush ribs 134 are crushed or deformed as the idler shaft 120 is pressed into the eccentric gear 118 to provide a tight lock against relative rotation between the idler shaft 120 and the eccentric gear 118. If the idler shaft 120 has an outer diameter of about 0.6240/0.6235 inches, for example, the crush ribs 134 can have a radial length of about 0.010 inches and form an inner diameter of about 0.6205/0.6165 inches. Preferably, the crush ribs 134 have a increasing width in a radially outward direction. For example, the crush ribs 134 can have a width which increases from about 0.006 inches at their inner diameter to about 0.013 inches at the wall of the central bore 130.

The eccentric gear 118 also has an integral stub shaft 136 which vertically extends from the top surface of the eccentric gear 118. Preferably, both the central bore 130 and the stub shaft 136 are located at a raised portion 138 of the upper surface of the eccentric gear 118. The axis of the stub shaft 136 is radially spaced-apart from the central axis of the eccentric gear 118. The stub shaft 136 is provided with a plurality of axially extending crush ribs 140 equally spaced about the circumference of the stub shaft 136. The eccentric gear 118 of the illustrated embodiment has twenty equally spaced-apart crush ribs 140. The crush ribs 140 provide an interference or press-fit between the inner ring 124 of the bearing 116 (FIGS. 2 and 3) and the stub shaft 136. The crush ribs 140 are crushed or deformed as the stub shaft is pressed into the inner ring 124 of the bearing 116 to provide a tight lock against relative rotation between the stub shaft 136 and the inner ring 124 of the bearing 116. If the bearing inner ring 124 has an inner diameter of about 0.5906/5902 inches, for example, the crush ribs 140 can have a radial length of about 0.010 inches and form an outer diameter of about 0.5900/0.5865 inches. Preferably, the crush ribs 140 have a increasing width in a radially outward direction. For example, the crush ribs 140 can have a width which increases from about 0.006 inches at their inner diameter to about 0.013 inches at the wall of the stub shaft 136. The eccentric gear 118 also has openings 142 on each side of the stub shaft 136 to reduce side-to-side imbalance forces during rotation of the eccentric gear 118.

As best shown in FIGS. 2 and 4, the eccentric gear 118 is rotatively mounted within the housing 34 by the idler shaft 120. The top end of the idler shaft 120 is press-fit into the eccentric gear 118 as described above. The bottom end of the idler shaft 120 is rotatively received in a vertical bore provided in a boss 144 on the underside of the lower housing section 80. A flange bearing 146 is provided at the top of the vertical bore and a sleeve bearing 148 is provided at the bottom of the vertical bore to rotatively support the idler shaft 120. Preferably the idler shaft 120 has a slip-fit with the bearings 146, 148. The eccentric gear 118 is meshed with the input pinion 112 so that rotation of the input shaft 36 directly rotates the eccentric gear 118 and idler shaft 120. As best shown in FIGS. 2 and 3, the stub shaft 136 upwardly extends through the inner ring 124 of the bearing 116 with a press-fit as described above so that the stub shaft 136 is securely journaled in the bearing inner ring 124. The central rotational axis of the bearing 116 and the central rotational axis of the eccentric gear 118 are vertical, parallel and laterally spaced apart.

The agitator rack 122 has a first end portion with a vertical bore 150 and a second end portion with a cavity 152 forming a rack of teeth 154. The vertical bore 150 forms a downward facing shoulder or abutment and is sized to receive the outer ring 126 of the bearing 116 with an interference or press-fit to rotatively connect the agitator rack 122 to stub shaft 136 of the eccentric gear 118. The top of the outer ring 126 is engaged against the abutment of the bore 150. The cavity 152 is laterally offset from the vertical bore 150 and so that the rack of teeth 154 are in driving contact with the agitator shaft 40. The longitudinal power transferring axis of the rack of teeth 154 is aligned with the central rotational axis of the bearing 116 to reduce vibration.

The second end portion of the agitator rack 122, opposite the vertical bore 150, is provided with a removable wear or bearing pad 156. The bearing pad 156 balances the agitator rack 122 by supporting the second end of the agitator rack on an upward facing support surface 158 of the lower housing section 80. The support surface 158 is preferably machined substantially flat such as, for example, to within about 0.010 inches. As the agitator rack 122 laterally or horizontally moves, the bearing pad 156 rides across the support surface 158. The bearing pad 156, therefore, preferably comprises a relatively low friction material such as, for example, nylon.

Figure 13:
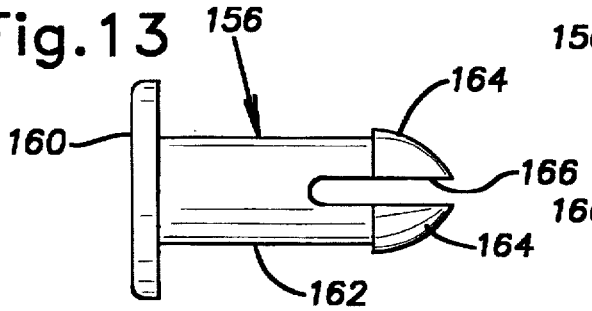
FIG. 13 is a longitudinal view of a bearing pad of the transmission of FIG. 2.
Figure 14:
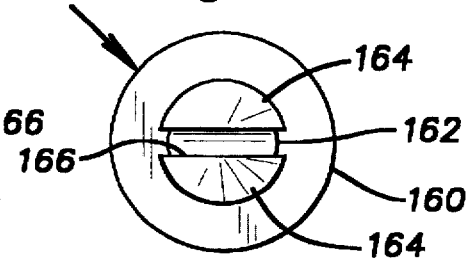
FIG. 14 is a top end view of the bearing pad of FIG. 13.

As best shown in FIGS. 13 and 14, the bearing pad 156 of the illustrated embodiment has a generally disk-shaped engagement portion 160 and a generally cylindrically-shaped integral attachment portion 162 extending from the top of the engagement portion 160. The attachment portion 162 is provided with a pair of protrusions 164 which extend radially outward from opposite sides of the attachment portion 162. The top of the attachment portion 162 also includes an longitudinally extending slot 166 so that the protrusions 164 can be resiliently deflected radially inward toward each other.

As best shown in FIGS. 2 and 3, the agitator rack 122 is provided with a vertically extending hole or opening 168 having a upwardly facing step or abutment. The bearing pad 156 is attached to the agitator rack 122 by inwardly deflecting the protrusions 164 and inserting the attachment portion 120 into the opening 168 at the lower side of the agitator rack 122. Upward movement of the attachment portion 162 into the opening 168 is continued until top side of the engagement portion 160 engages the lower side of the agitator rack 122 and the protrusions 164 resiliently deflect radially outward above the abutment. The bearing pad 156 is removably secured to the agitator rack 122 by the protrusions 164 engaging the abutment of the opening 16.

As best shown in FIGS. 1 and 2, the inside of the agitator tube 94 is provided with a flange bearing 170 at the bottom of the agitator tube 94 and a sleeve bearing 172 at the top of the agitator tube 94. The agitator shaft 40 is rotatively mounted, relative to the agitator tube 94, within the bearings 170, 172. Preferably, a seal 174 is provided between the agitator shaft 40 and the agitator tube 94 at the top of the agitator tube 94 above the sleeve bearing 172. The vertical rotational axis of the agitator shaft 40 is in-line with, that is coaxial with, the vertical rotational axis of the input shaft 36 which allows the use of a simple thrust bearing ball 176 to support the agitator shaft 40. The thrust bearing ball 176 is located between the upper end of the input shaft 36 and the lower end of the agitator shaft 40 to both locate the shafts 36, 40 axially in position and provide a thrust bearing for the agitator shaft 36.

An agitator gear 178 is splined on the lower end of the agitator shaft 40 and is drivingly connected with the rack of teeth 154 of the agitator rack 122. A retaining ring 180 is provided below the agitator gear 178 to axially secure the agitator gear 178 on the agitator shaft 40.

As best shown in FIGS. 2–4, the lower housing section 80 has an integral flange 182 for securing the counterweight 42 to the housing 34. The flange 182 is located on a side of the lower housing section 80 laterally opposite the eccentric gear 118 and idler shaft 120 and extends laterally outward from the top of the lower housing section 80 adjacent the parting line of the housing 34. The counterweight 42 is secured below the flange 182 and adjacent the side of the lower housing section generally at a vertical position generally equal to that of the eccentric gear 118. The counterweight 42 is attached to the flange 182 with a threaded bolt 184 which downwardly extends through an opening in the flange 182 into a threaded hole in the counterweight 42. Preferably, known means are provided for locking the bolt 184 in the threaded hole. A rubber isolator 186 is provided between the counterweight 42 and the side of the lower housing section 80 to isolate the counterweight 42 from the side of the housing 34 and minimize noise which may be created therebetween during operation of the transmission 22. The counterweight 42 is sized and located to balance the transmission 22 during the spin mode. Accordingly, the counterweight 42 is substantially in line with the vertical axis of the input and agitator shafts 36, 40 and the vertical axis of the eccentric gear 118 and idler shaft 120.

As best shown in FIG. 2, the clutch/brake system 44 includes a first one-way clutch having an upper hub 188 and an upper or small helical spring 190 and a second one-way clutch having a lower hub 194 and a lower or large helical spring 196. The cylindrically-shaped upper hub 188 is splined on the upper end of the input shaft 36 between the input pinion 112 and a upward facing shoulder or abutment of the input shaft 36. Preferably, a washer 198 is provided above the small spring 190 and between the upper hub 188 and the input pinion 112 to reduce friction. The upper hub 188 has an outer diameter substantially equal to the outer diameter of the input tube 88. The small spring 190 is positioned on the exterior surface of an upper portion of the input tube 88 and the exterior surface of the upper hub 188. Preferably, a washer is provided below the small spring 190 at the lower housing section 80 to reduce friction.

The small spring 190 is dimensioned to provide an interference fit with both the input tube 88 and the upper hub 188 to form the first one-way clutch. In one direction of rotation of the input shaft 36, corresponding to the agitation mode, the small spring 190 allows the input shaft 36 to rotate relative to the input tube 88 and housing 34. In the other direction of rotation of the input shaft 36, corresponding to the spin mode, the small spring 190 transmits torque between input shaft 36 and the input tube 88, and thereby the housing 34, so that the transmission 22 rotates as one rigid body about the vertical axis of the input and agitator shafts 36, 40.

The cylindrically-shaped lower hub 194 is secured to the bottom of the lower housing section 80 with screws 202 which extend through openings in the lower hub 194 and into threaded holes in the bottom of the lower housing section 80. The lower hub 194 is located above the retaining ring 50 of the lower bearing assembly 32. The lower hub 194 has an outer diameter substantially equal to the outer diameter of the upper portion of the bearing retainer exterior surface 54. The large spring 196 is positioned on the exterior surface 54 of the bearing retainer 48 and the exterior surface of the lower hub 194.

The large spring 196 is dimensioned to provide an interference fit with both the bearing retainer 48 and the lower hub 194 to form the second one-way clutch or brake which limits rotation of the housing 34 relative to the bearing retainer 48, and thereby to the frame wall 76 of the washing machine 10, to one direction. In one direction, corresponding to the direction of rotation of the input shaft 36 during the agitation mode, the large spring 196 locks the housing 34 to the non-rotating bearing retainer 48. In the other direction of rotation of the housing, corresponding to the direction of rotation of the input shaft 36 during the spin mode, the large spring 196 allows the housing 34 to rotate relative to the bearing retainer 48. Preferably, a washer 204 of a low friction material such as, for example, Teflon is provided above the large spring 196 at the bottom of the lower housing section 80 to reduce friction therebetween.

As best shown in FIG. 1, the agitator shaft 40 and agitator tube 94 extend upwardly through bottom openings in the inner and outer tubs 12, 14. An attachment member 206 is secured to the bottom wall of the inner tub 12 and to the agitator tube 94 so that the inner tub 12 is rigidly secured to the agitator tube 94 and rotates with the agitator tube 94. A seal member 208 is provided between the outer tub 14 and the agitator tube 94 to prevent wash liquid within the outer tub 14 from flowing or leaking down the agitator tube 94.

The agitator 16 has a cylindrical sleeve 210 which is coaxial with the agitator shaft 40 and projects downwardly from a partition wall 212. The agitator shaft 40 has a spline-connection with the sleeve 210 of the agitator 16 so that the agitator 16 rotates with the agitator shaft 40. A threaded bolt 214 extends through the wall 212 of the agitator 16 and into a threaded hole in the top of the agitator shaft 40 to secure the agitator 16 to the agitator shaft 40 and prevent relative axial or longitudinal movement between the agitator 16 and the agitator shaft.

At the proper time in the operation of the washing machine 10, the agitation mode is initiated by operating the motor 20 in a first or agitation direction which, through the drive belt 28 and pulleys 26, 30, drives the input shaft 36 in the first direction. In this first direction of rotation, the small spring 190 of the first one-way clutch allows the input shaft 36 to rotate relative to the input tube 88 and the housing 34. As mentioned above, the large spring 196 of the second one-way clutch secures the housing 34 to the washing machine frame wall 76 in this first direction.

The rotating input shaft 36 drives the eccentric gear 118 with the input pinion 112 so that the eccentric gear 118 and idler shaft 120 rotate within the bearings 146, 148. The stub shaft 136, and the agitator rack 122 rotatably attached thereto, revolve around the vertical axis of the eccentric gear 118 as the eccentric gear 118 rotates to convert the unidirectional rotational motion of the eccentric gear 118 into a linear oscillatory motion of the agitator rack 122. The rack of teeth 154 of the agitator rack 122 drive the agitator gear 178 of the agitator shaft 40 to convert the linear oscillatory motion of the agitator rack 122 into a reversing rotational motion of the agitator shaft 40. Therefore, the agitation system 38 converts the unidirectional rotation of the input shaft 36 into a reversing rotational movement of the agitator shaft 40. The agitator shaft 40 thereby drives the agitator 16 in a back-and-forth motion within the inner tub 12.

At the proper time in the operation of the washing machine 10, the spin mode is initiated by reversing the direction of the motor 20 from that of the agitation mode to a second or spin direction which, through the drive belt 28 and pulleys 26, 30, drives the input shaft 36 in the second direction. In this second direction of rotation, the small spring 190 of the first one-way clutch transmits torque from the input shaft 36 to input tube 88 of the housing 34 so that the transmission 22 rotates in unison as one rigid body. As mentioned above, the large spring 196 of the second one-way clutch allows the housing 34 to rotate with respect to the washing machine frame wall 76 in this second direction.

The rotation of the housing 34 thereby spins the inner tub 12, which is secured to the agitator tube 88 of the housing 34, within the outer tub 12 in a constant direction of rotation. Because the whole transmission 22 rotates with the input shaft 36, there is no oscillatory output at the agitation shaft 40 and the agitator 16 spins with the inner tub 12 without agitation.

Although particular embodiments of the invention have been described in detail, it will be understood that the invention is not limited correspondingly in scope, but includes all changes and modifications coming within the spirit and terms of the claims appended hereto.

What is claimed is:

1. A transmission for a washing machine comprising:

a housing;

an agitator shaft rotatably mounted to said housing;

an input shaft rotatably mounted to said housing; and an agitation system connecting said input shaft with said agitator shaft whereby rotation of said input shaft relative to said housing provides back-and-forth agitation of said agitator shaft, said agitation system including a rack drivingly connected to said agitator shaft, an eccentric gear rotatably mounted to said housing and drivingly connected to said input shaft, and a rolling-contact bearing rotatably connecting said eccentric gear and said rack, said bearing having a rotational axis displaced from a rotational axis of said eccentric gear.

2. The transmission according to claim 1, wherein said rolling-contact bearing is a radial ball bearing.

3. The transmission according to claim 2, wherein said rolling-contact bearing is press-fit with said rack.

4. The transmission according to claim 1, wherein said rolling-contact bearing is press-fit with said eccentric gear.

5. The transmission according to claim 4, wherein said press-fit between said rolling-contact bearing and said eccentric gear is provided by crush ribs on said eccentric gear.

6. The transmission according to claim 1, wherein said agitator system includes an idler shaft rotatably connecting said eccentric gear to said housing, said idler shaft having a first end fixed to said eccentric gear and a second end rotatably mounted to said housing whereby said idler shaft is rotatable with said eccentric gear relative to said housing.

7. A transmission for a washing machine comprising:

a housing;

an agitator shaft rotatably mounted to said housing;

an input shaft rotatably mounted to said housing; and an agitation system connecting said input shaft with said agitator shaft whereby rotation of said input shaft relative to said housing provides back-and-forth agitation of said agitator shaft, said agitation system including a rack drivingly connected to said agitator shaft, an eccentric gear drivingly connecting said rack and said input shaft, and an idler shaft rotatably connecting said eccentric gear to said housing, said idler shaft having a first end fixed to said eccentric gear and a second end rotatably mounted to said housing whereby said idler shaft is rotatable with said eccentric gear relative to said housing.

8. The transmission according to claim 7, wherein said idler shaft is press-fit with said eccentric gear.

9. The transmission according to claim 8, wherein said press-fit between said idler shaft and said eccentric gear is provided by crush ribs on said eccentric gear.

10. The transmission according to claim 7, wherein said housing is provided with at least one sleeve bearing and said idler shaft is slip-fit with said sleeve bearing.

* * * * *